US008191621B2

(12) United States Patent
Sweeney et al.

(10) Patent No.: US 8,191,621 B2
(45) Date of Patent: Jun. 5, 2012

(54) CASING STABBING GUIDE AND METHOD OF USE THEREOF

(75) Inventors: David Sweeney, Calgary (CA); Allen Littlewood, Calgary (CA)

(73) Assignee: Tesco Corporation, Houston, TX (US)

( * ) Notice: Subject to any disclaimer, the term of this patent is extended or adjusted under 35 U.S.C. 154(b) by 260 days.

(21) Appl. No.: 12/475,133

(22) Filed: May 29, 2009

(65) Prior Publication Data

US 2010/0300704 A1 Dec. 2, 2010

(51) Int. Cl.
*E21B 19/18* (2006.01)

(52) U.S. Cl. ..... 166/77.52; 166/85.1; 166/85.5

(58) Field of Classification Search ..... 166/379, 166/380, 77.51, 77.52, 85.1, 85.5; 414/22.51–22.71
See application file for complete search history.

(56) References Cited

U.S. PATENT DOCUMENTS

| | | | | |
|---|---|---|---|---|
| 4,223,920 | A * | 9/1980 | Van Bilderbeek | 285/24 |
| 4,791,997 | A * | 12/1988 | Krasnov | 175/57 |
| 4,793,422 | A | 12/1988 | Krasnov | |
| 5,433,279 | A | 7/1995 | Tessari et al. | |
| 6,443,241 | B1 | 9/2002 | Juhasz et al. | |
| 6,527,493 | B1 | 3/2003 | Kamphorst et al. | |
| 7,004,259 | B2 | 2/2006 | Pietras | |
| 7,219,744 | B2 | 5/2007 | Pietras | |
| 7,377,324 | B2 | 5/2008 | Beierbach et al. | |
| 2004/0159425 | A1 * | 8/2004 | Webre et al. | 166/66 |
| 2005/0098352 | A1 * | 5/2005 | Beierbach et al. | 175/57 |
| 2007/0193751 | A1 * | 8/2007 | Pietras et al. | 166/380 |

FOREIGN PATENT DOCUMENTS

| | | |
|---|---|---|
| WO | WO 96/18799 | 6/1996 |

* cited by examiner

*Primary Examiner* — Cathleen Hutchins
(74) *Attorney, Agent, or Firm* — Bracewell & Giuliani LLP

(57) ABSTRACT

A system for running a string of casing into a well utilizes a casing gripping assembly. The casing gripping assembly connects to a top drive and has radially movable gripping elements. A pair of links have upper ends pivotally connected to the casing gripping assembly. A casing elevator is mounted below the casing gripping assembly to lower ends of the links. A guide is mounted to the links between the elevator and the casing gripping assembly. The guide has a vertically extending central opening that has a lower portion that defines a flared entrance to the opening.

10 Claims, 3 Drawing Sheets

CASING STABBING GUIDE AND METHOD OF USE THEREOF

FIELD OF THE INVENTION

This invention relates in general to equipment for connecting a joint of casing to a string of casing suspended by spider at the rig floor, and in particular to a guide for guiding a casing gripper into the upper end of a joint of casing.

BACKGROUND OF THE INVENTION

Casing comprises pipe that is used to line a wellbore and is cemented in place. The casing may extend all the way to the wellhead at the top of the well, or it may extend up only to the lower end of a next upper string of casing. In the latter instance, the casing is typically referred to as a liner. The casing may be installed in a portion of the wellbore that has been previously drilled by drill pipe. Alternately, the casing may itself be used as the drill string to drill portions of the well.

In either event, the individual joints or sections of casing are secured to each other to make up a casing string being lowered into the well. When adding a new joint of casing to a string of casing, the string of casing will be supported by a spider at the rig floor. The spider has a set of slips that support the weight of the casing string. In one technique, the drilling rig has a top drive, which is a rotary power source that travels up and down the drilling rig. A casing gripper is secured to the quill or drive stem of the top drive. The casing gripper has radially moveable gripping elements that will grip either the inner diameter or outer diameter of the joint of casing. A set of links, also called bails, are mounted to the casing gripper to support a casing elevator below the lower end of the casing gripper. The elevator comprises a clamp that fits around the casing joint below the collar on the upper end of the casing joint. Hydraulic cylinders will pivot the bails outward to engage the next joint of casing, which may be spaced laterally from the spider and inclined on a ramp or V-door.

After clamping the elevator around the joint of casing, the driller raises the top drive and allows the links to swing back into vertical alignment with the top of the string of casing. The operator then lowers the top drive and the joint of casing until it lands on and is supported by the string of casing. The operator continues to lower the top drive and the casing gripper while the joint of casing remains supported on top of the string of casing. The gripping elements of the casing gripper will slide into or over the upper end of the joint of casing. Once in place, the operator actuates the casing gripper to grip the joint of casing, then rotates the gripping element to rotate the joint of casing and make it up with the string of casing.

In some instances, the elevator links are quite long because they must be able to pivot laterally outward to engage the next joint of casing as it is supported on the V-door. In large rigs, this lateral distance can be substantial. The operator may be able to adjust the length of the links or use longer links. However, longer links place the elevator several feet below the lower end of the casing gripper. This arrangement makes it difficult for the driller to stab the casing gripper into or over the upper end of the casing, particularly with small diameter casing. The upper end of the casing may be 35 to 40 feet above the driller when the stabbing has to occur, making it difficult to see. Having elevator a considerable distance below the casing gripper results in extra time required for making up a new joint of casing with the casing string.

SUMMARY OF THE INVENTION

In this invention, a guide is mounted to the links between the elevator and the casing gripping assembly. The guide has a central opening sized for receiving an upper end of the joint of casing to be connected to the string of casing. Preferably, this central opening is flared at its lower end so as to guide the upper end of the joint of casing as the casing gripper is lowered into or over it. The upper end of the opening may also be flared.

Optionally, a resilient centering device, such as bow springs or spring loaded roller balls, may be located in the guide opening to guide the upper end of the joint of casing. Optionally, a sensor may be mounted to or adjacent the guide for sensing when the gripper and the upper end of the joint of casing engage each other.

DETAILED DESCRIPTION OF THE INVENTION

Figure 1A:
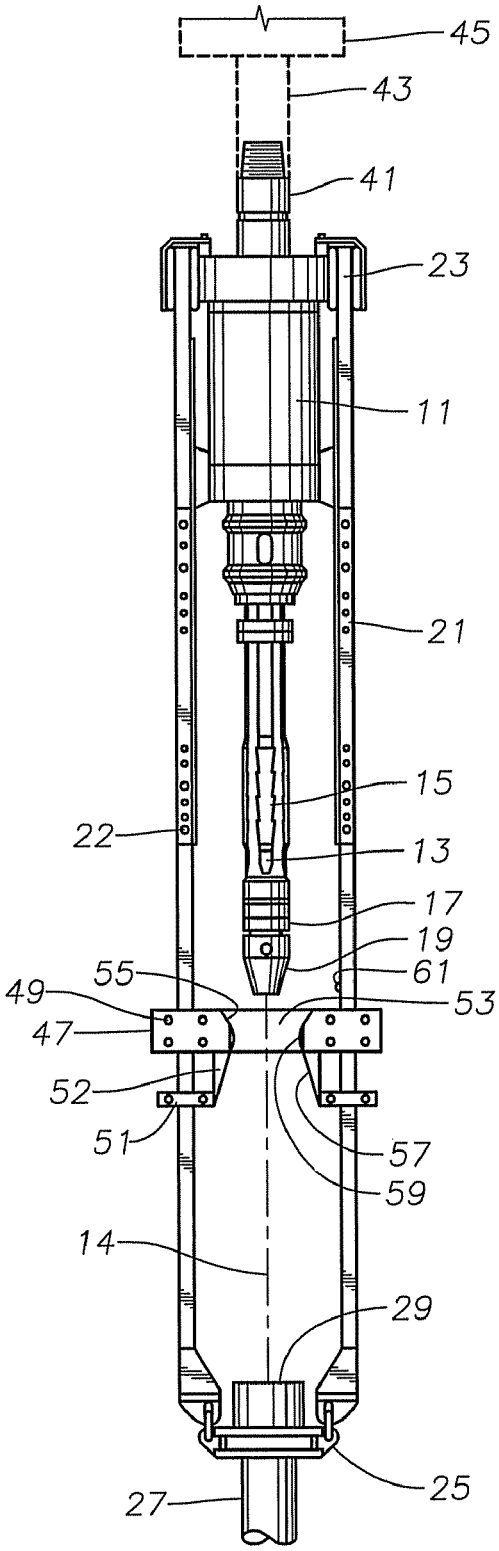
FIGS. 1A and 1B comprise a side elevational view, partially sectioned, of a casing gripper having a guide in accordance with the invention and shown suspending a joint of casing above a string of casing.

Referring to FIG. 1, a casing gripper 11 includes an actuator portion and a spear 13 extending below and having a longitudinal axis 14. Several gripping elements 15 are spaced circumferentially around spear 13. In this example, gripping elements 15 are on cam or ramp surfaces of spear 13. When the actuator portion of casing gripper 11 strokes gripping elements 15, they will move radially outward. Alternately, they could be mounted within a housing surrounding spear 13 for radial inward movement when stroked. A seal 17 is located on spear 13 below gripping elements 15 in this embodiment. Spear 13 has a passage through it with an opening in a nose 19 for discharging drilling fluid.

A pair of bails or links 21 is mounted to casing gripper 11. Links 21 have upper ends 23 that have cylindrical co-axial apertures for receiving axles (not shown) extending outward from opposite sides of casing gripper 11. Hydraulic cylinders (not shown) will pivot links 21 about their upper ends 23. Upper ends 23 and casing gripper 11 are preferably constructed as in U.S. Pat. No. 7,140,443, so that each link 21 rotates in a single plane. Referring still to FIG. 1A, links 21 may have a fixed length. Alternately, the lengths of links 21 can be adjusted, then secured to a selected new length. In this embodiment, links 21 are adjusted by sliding portions relative to each other, then securing the portions by fasteners or pins 22.

An elevator 25 is mounted to the lower ends of links 21. Elevator 25 is a clamp that is radially opened and closed, either manually or hydraulically. Elevator 25 has an opening sized to loosely receive a joint of casing 27. Joint 27 has a collar 29 on its upper end that has a larger diameter than the opening in elevator 25, so that elevator 25 will lift casing joint 27, but is also able to slide downward on casing joint 27 if the casing joint is stationarily supported. Casing joint 27 has a lower end that normally will have external threads 31 as shown in FIG. 1B.

Figure 1B:
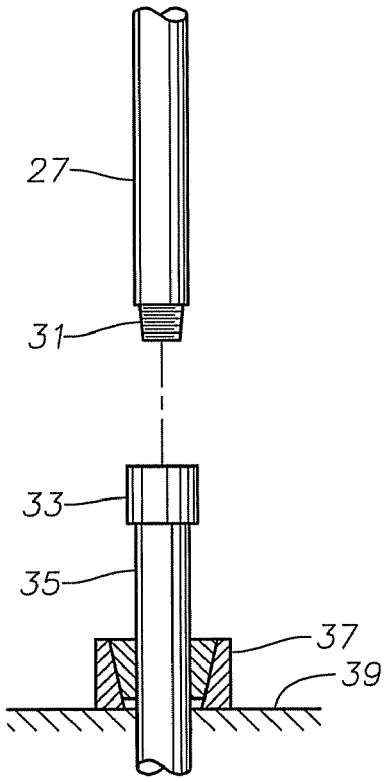

Referring still to FIG. 1B, threaded end 31 is adapted to stab and be rotated into threaded engagement with a collar 33 located at the upper end of the uppermost casing joint of a casing string 35. Casing string 35 is made up of joints of casing secured in the same manner as will be subsequently described. Casing string 35 is supported by a spider 37 located either flush with or on a rig floor 39 of a drilling rig. Spider 37 has slips that will grip the side wall of casing string 35 to support its weight.

Figure 2A:
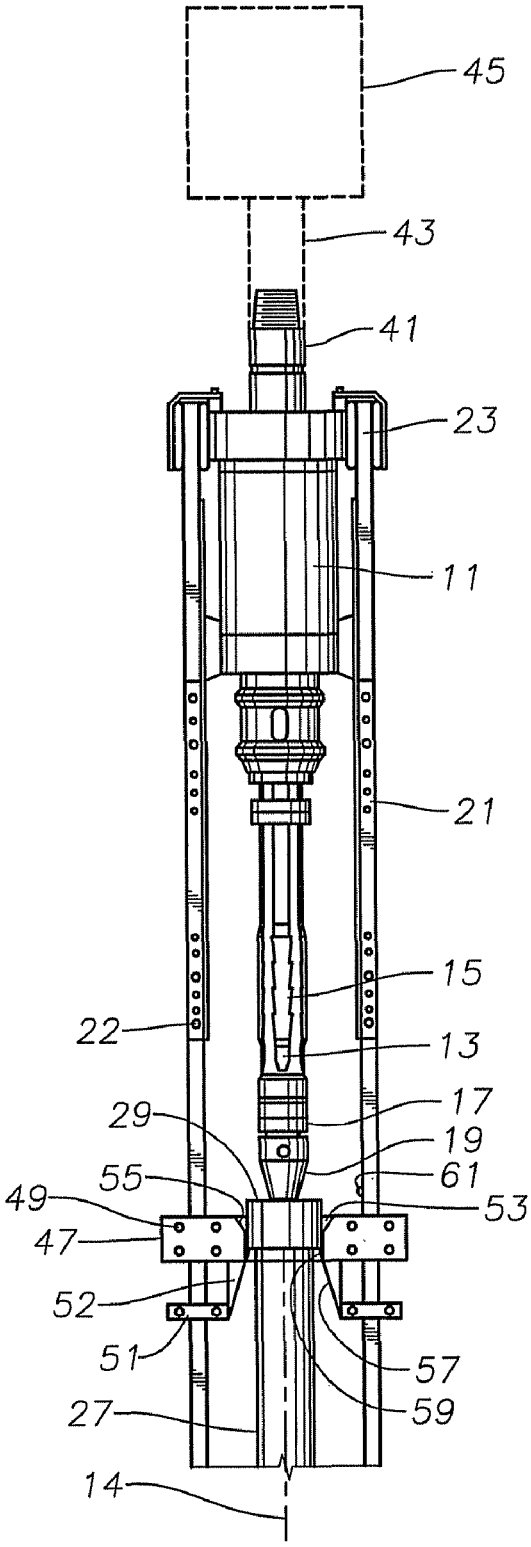
FIGS. 2A and 2B comprise a side elevational view, partially sectioned, of the casing gripper of FIG. 1, and showing the joint of casing being supported on but not yet secured to the string of casing.

A threaded stem 41 is located on the upper end of casing gripper 11 for rotating spear 13 relative to links 21. Threaded stem 41 extends through the housing of casing gripper 11 and is supported by bearings so that it will rotate relative to the housing of casing gripper 11. An anti-rotation device (not shown) prevents rotation of the housing of casing gripper 11 and links 21. Threaded stem 41 secures to a drive stem or quill 43 of a top drive 45 (FIG. 2A). Top drive 45 is moveable up and down the derrick along one or more rails (not shown). Top drive 45 comprises a motor that is either hydraulically or electrically driven for rotating quill 43.

A guide 47 is mounted to links 21 above elevator 25 and a short distance below nose 19 of gripper 11 when links 21 are vertical. Guide 47 extends between links 21 and preferably comprises at least two halves of a body that are clamped together by bolts 49. Optionally, guide 47 may have a lower clamp 51 that is located below the body and separately clamped to links 21. An opening 53 extends through the body of guide 47. When links 21 are in the vertical position, the axis of the opening of elevator 25 is coaxial with axis 14 of spear 13.

Opening 53 may have a flared upper portion 55. In this embodiment, upper portion 55 is conical and has an increasing diameter in an upward direction. Similarly, opening 53 may have a flared lower portion 57 that increases in diameter in a downward direction. In this embodiment, lower flared portion 57 has a greater axial length than upper flared portion 55 and a greater diameter at its lower end than the upper end of upper flared portion 55. In this example, lower flared portion 57 is defined by a plurality of blades or segments 52 spaced in a circular array around axis 14 with gaps between each segment 52. The inner edges of segments 52 circumscribe or define flared lower portion 57 of opening 53. The lower ends of segments 52 may be attached, such as by welding, to lower guide clamps 51. The upper ends of segments 52 are also secured, such as by welding, to the body of guide 47. Rather than blades or segments 52, the lower flared portion 57 could be a conical bore formed by two mating halves of a body in the same manner as upper flared portion 55.

Optionally, a resilient centering device or devices 59 may be mounted within the central portion of opening 53. Centering devices 59 may comprise devices such as bow springs or roller balls that are biased by springs radially inward toward the axis of spear 13.

In addition, a sensor 61 may be mounted to or adjacent guide 47. Sensor 61 will detect the presence of collar 29 and provide a signal to the driller. Sensor 61 could be an optical device, such as one employing a laser beam that is interrupted by the presence of one of the collars 29. Sensor 61 may include a transmitter for making a wireless transmission to a receiver located near or on the driller's control panel.

In operation, the operator picks up casing joint 27 in a conventional manner. Initially, casing joint 27 may be located laterally from spider 37 (FIG. 1B) and supported at an inclination by a V-door of the rig. The operator will tilt links 21 about upper ends 23 and relative to axis 14 and secure elevator 25 around casing joint 27. The operator then lifts top drive 45 while allowing links 21 to pivot back to a vertical orientation, placing casing joint 27 in the position shown in FIG. 1A. The lower threaded end 31 of casing joint 27 will be spaced above collar 33 of the uppermost casing joint of casing string 35. The distance from nose 19 to collar 29 on casing joint 27 may be several feet.

Figure 2B:
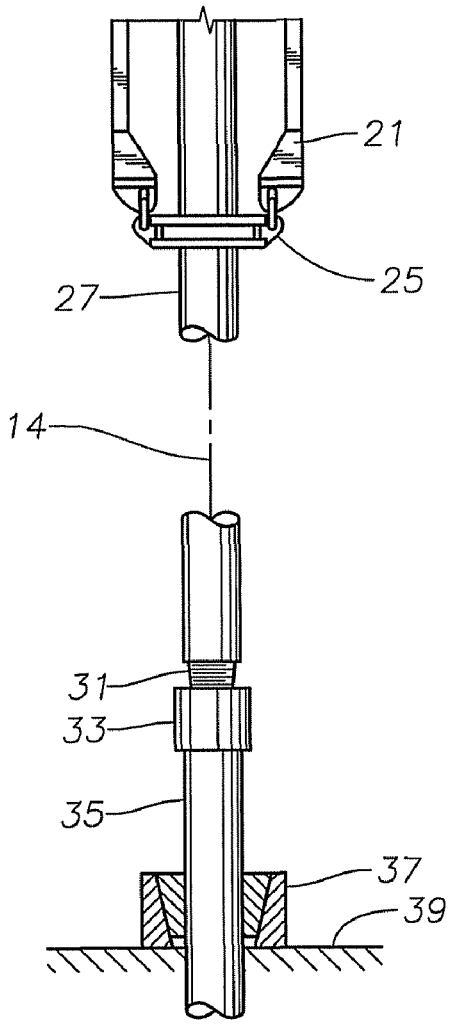

The operator then lowers top drive 45 until casing joint threaded end 31 lands in casing collar 33, as shown in FIG. 2B. The portion of casing string 35 above spider 37 will support the weight of casing joint 27 at this point, but threads 31 are not yet made up to the internal threads in casing collar 33. The operator continues lowering top drive 45, which causes guide 47 to approach and receive casing joint collar 29, as shown in FIG. 2A. Flared lower portion 57 will center casing collar 29 on axis 14 as guide 47 slides downward over casing collar 29. At the point shown in FIG. 2A, nose 19 has begun to enter casing collar 29. Guide 47 is positioned such that it will move over at least a part of the casing joint collar 29 before casing gripper nose 19 begins to enter casing joint 27.

Figure 3A:
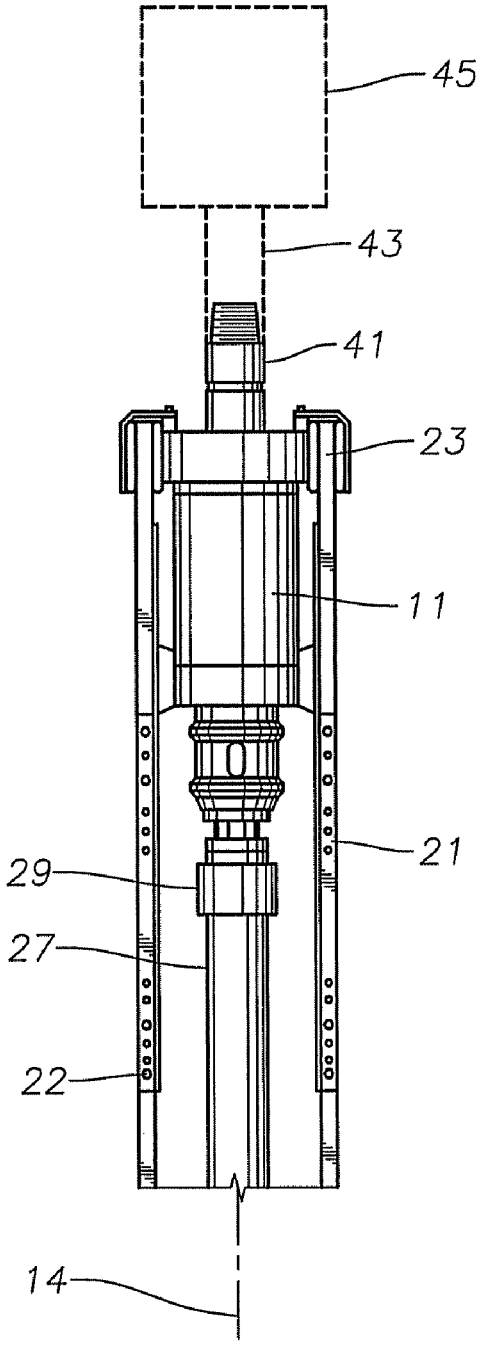
FIGS. 3A and 3B comprise a side elevational view of the casing gripper of FIG. 1, showing the joint of casing being gripped by the casing gripper and being made up to the string of casing.

If sensor 61 is employed, it detects the presence of collar 29 as guide 47 moves below collar 29. Sensor then informs the driller that nose 19 is now entering the bore of casing joint 27. The driller continues lowering casing gripper 11 a short distance, at which time gripping elements 15 will be fully enclosed within casing joint 27 as shown in FIG. 3A. Optionally, the upper end of collar 29 will abut a stop when gripping elements 15 (FIG. 2A) are fully located within casing joint 27.

Figure 3B:
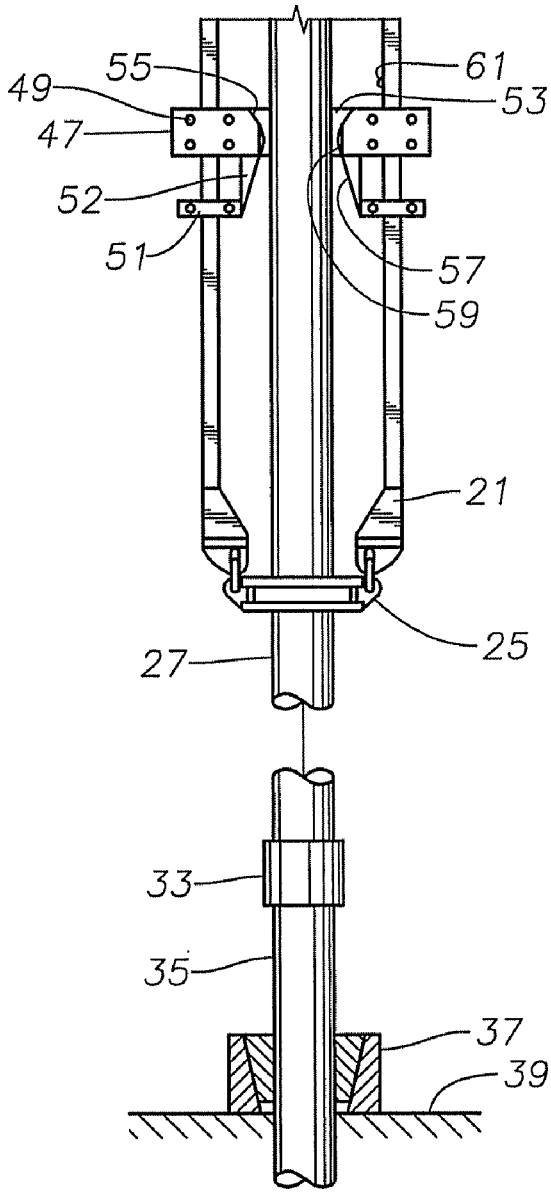

The operator then supplies power to the actuator of casing gripper 11, which causes gripping elements 15 (FIG. 2A) to move radially outward into gripping engagement with the inner diameter of casing joint 27. The operator then supplies power to top drive 45 to rotate quill 43, which in turn causes casing joint 27 to rotate. This results in threads 31 (FIG. 2B) making up to a desired torque with the threads in casing collar 33, as shown in FIG. 3B.

At this point, collar 29 of casing joint 27 will be spaced several feet above guide 47, and elevator 25 will be spaced several feet below casing joint collar 29. The operator then lifts top drive 45 a short distance and releases spider 37. Once released, the operator lowers top drive 45, which lowers casing joint 27 and casing string 35. When the upper end of casing joint 27 is near spider 37, the operator actuates spider 37 to engage casing joint 27, which is now the uppermost joint or section of casing string 35. The operator releases elevator 25, releases gripping elements 15 (FIG. 2A) and lifts top drive 45 while casing joint 27 is supported by spider 37. Guide 47 will slide up past collar 29, with flared upper portion 55 centering guide 47 relative to collar 29 to prevent damage to the lower edge of collar 29. Once guide 47 is above collar 29, the operator may then pivot links 21 outward to engage the next joint of casing.

The guide is particularly useful when the links are quite long, in that it centers the upper end of the casing joint with the casing gripper. The guide may be employed when running casing into a previously drilled wellbore and also when drilling with casing. Although shown in connection with an internal gripping mechanism, the same is applicable to an external casing gripper.

While the invention has been shown in only one of its forms, it should be apparent to those skilled in the art that it is not so limited but is susceptible to various changes without departing from the scope of the invention.

The invention claimed is:

1. An apparatus for running a string of casing into a well, comprising:

a casing gripping assembly having movable casing gripping elements;

a pair of links having upper ends carried by the casing gripping assembly;

a casing elevator mounted below the casing gripping assembly to lower ends of the links, the elevator comprising a clamp that radially opens and closes around a joint of casing to be lifted and connected to the string of casing;

a guide mounted to the links at a fixed distance between the upper ends and the lower ends of the links between the elevator and the casing gripping assembly, the guide having a central opening sized for receiving an upper end of the joint of casing as the links are lowered relative to the joint of casing; and a resilient centering device in the central opening of the guide.

2. The apparatus according to claim 1, wherein the links are pivotally mounted relative to the casing gripping assembly, and the guide moves in unison with the links.

3. The apparatus according to claim 1, wherein a lower portion of the opening in the guide tapers outward in a downward direction.

4. The apparatus according to claim 1, wherein an upper portion of the opening in the guide tapers outward in an upward direction.

5. An apparatus for running a string of casing into a well, comprising:

a casing gripping assembly having radially movable casing gripping elements;

a pair of links having upper ends pivotally carried by the casing gripping assembly;

a casing elevator mounted below the casing gripping assembly to the links;

a guide mounted between the links at a position between the elevator and the casing gripping assembly, the guide having a central opening that has a lower portion defining a lower flared entrance to the opening; and an upper portion in the central opening of the guide that defines an upper flared entrance to the opening.

6. The apparatus according to claim 5, wherein the links are pivotally mounted relative to the casing gripping assembly, and the guide moves in unison with the links.

7. The apparatus according to claim 5, wherein the guide is positioned slightly below a lower end of the casing gripping assembly when the links are oriented vertically.

8. The apparatus according to claim 5, further comprising:

a resilient centering device in the central opening of the guide.

9. The apparatus according to claim 5, further comprising a sensor carried by the links that senses an entrance of an upper end of a joint of casing into the guide.

10. The apparatus according to claim 5, wherein the casing gripping elements are mounted to a spear for radial movement relative to the spear.

* * * * *